US005133684A

United States Patent [19]

Rhodes et al.

[11] Patent Number: 5,133,684

[45] Date of Patent: Jul. 28, 1992

[54] WIRE SUPPORT APPARATUS

[75] Inventors: Carl Rhodes, St. Louis; Robert J. Brown; Bernard J. Kemper, both of Bonne Terre, all of Mo.

[73] Assignee: Handi-Craft Company, St. Louis, Mo.

[21] Appl. No.: 529,950

[22] Filed: May 29, 1990

[51] Int. Cl.[5] ..... A63H 33/00

[52] U.S. Cl. ..... 446/489; 446/228; 248/153

[58] Field of Search ..... 446/228, 141, 489; 248/153, 154; 403/405.1, 406.1; 434/258, 259; 24/129.6, 457, 458, DIG. 10

[56] References Cited

U.S. PATENT DOCUMENTS

| | | | |
|---|---|---|---|
| 951,283 | 3/1910 | Krischer | 403/406.1 X |
| 2,282,881 | 5/1942 | Ostrow | 496/227 |
| 2,566,886 | 9/1951 | Hartman | 24/958 X |
| 2,858,641 | 11/1958 | Trimble | 446/227 |
| 3,401,960 | 9/1968 | Saunders . | |
| 3,581,408 | 6/1971 | Mohier | 434/258 |
| 3,699,704 | 10/1972 | Hakim | 446/227 |
| 4,188,745 | 2/1980 | Harvey et al. | 446/227 |
| 4,966,482 | 10/1990 | Fujimoto | 403/405.1 X |

FOREIGN PATENT DOCUMENTS

| | | | |
|---|---|---|---|
| 2038067 | 7/1980 | United Kingdom | 434/258 |

*Primary Examiner*—Robert A. Hafer
*Assistant Examiner*—Sam Rimell
*Attorney, Agent, or Firm*—Herzog, Crebs & McGhe

[57] ABSTRACT

A wire retaining apparatus is disclosed. In the preferred embodiment this wire retaining apparatus is used in the construction of a child's activity toy generically referred to as a bead maze. The wire retaining apparatus includes a plug and a receptacle. The apparatus is designed to secure an elongate rigid wire having an L-shaped terminus. The L-shaped terminus of the wire engages an L-shaped channel in the plug. The plug has one or more prongs extending from the side thereof. The plug and the wire engage a receptacle formed in a base or other suitable support structure. The receptacle includes one or more slots to receive the prongs. A shoulder on each prong engages a shoulder formed in each slot of the plug in the receptacle. A foot extends from the plug and engages a step in the bottom of the receptacle. The foot is formed from resilient material and tends to urge the plug upward into locking engagement and into a generally coplanar relationship with the support structure. In an alternative embodiment the foot can be formed in the receptacle to engage the plug to urge the plug upward.

10 Claims, 3 Drawing Sheets

WIRE SUPPORT APPARATUS

BACKGROUND OF THE INVENTION

1. Field of the Invention

The invention relates to a wire support apparatus. In the preferred embodiment the apparatus is used to support a plurality of generally upright wires in a child's activity toy which is generically called a bead maze. However, the invention is not limited to toys; it may also be applied in the construction industry or in general manufacturing as a new type of fastening device.

2. Description of the Prior Art

In the general art of fasteners and securing devices, there have been several patents dealing with L-shaped rods and wires. U.S. Pat. No. 1,142,979 discloses a "Clevis Link Connection." A lever is connected to an L-shaped operating rod by a clip. In automobiles, boats and stationary engines, it is convenient to operate such a lever at a distance by means of the operating rod. The clip does not lock the operating rod in a fixed position to the lever; rather, the operating rod, or push rod, engages the lever and can move it to and fro at the operators discretion. The present invention locks an elongate wire into a rigid position and does not permit rotation or movement as described in the aforementioned patent.

U.S. Pat. No. 3,102,745 discloses a "Securing Device." In this invention, an L-shaped rod is secured to a lever by a U-shaped securing clamp or bracket. This securing device differs from the present invention because it does not have any prongs to lock the rod or wire into a rigid position with a base or other receptacle.

U.S. Pat. No. 3,401,960 discloses a "Rod End Fastener." The Fastener is designed to engage an L-shaped rod. The fastener is an integral member molded from a plastic material which is resilient and adapted to flow under moderate pressure. The fastener has a clamping member which engages the rod and an annular ring or socket which defines a locking shoulder. The annular ring is designed to penetrate an aperture in a base or support until the locking shoulder has penetrated the aperture. The L-shaped wire is then secured to a support structure. Apparently this particular fastening device can be used for securing the end of an automobile door knob lock to the locking mechanism of the door. This particular fastener is installed in the support structure in a three step operation. First the socket portion of the fastener is forced through an aperture in the support structure. Thereafter the L-shaped portion of the rod is forced into an opening defined in the socket. The L-shaped rod is then rotated about the axis to engage a clamping means. In the present invention the rod and the clamp are inserted into the base or support structure in a one step operation.

U.S. Pat. No. 3,061,340 discloses a "Fastener." This fastener is designed to articulate with a cranked member and an aperture member. The aperture member is a flat bar or lever formed with a circular aperture on one end. The cranked member is a rod bent at right angles to form a crank which passes through the aperture in the bar or lever. This articulated joint does not lock the rod or wire into a rigid location with a base or other support structure like the present invention.

U.S. Pat. No. 2,651,671 discloses an "Electrical Connection." This connection can be used outside in extreme weather conditions to splice cable ends in a single operation using a simple instrument like a wide jaws plier. The connector consists of a male member, a female member and two rams serving to splice wires together. The rams consist of an L-shaped piece of metal. The connector is not used to join an L-shaped wire or other member.

In the field of toys, the general notion of a bead maze is old in the art. A bead maze consists primarily of three elements comprising a) a base, b) a plurality of curved and twisted rigid wires mounted on the base and c) a plurality of beads which are movable along the wires. The wires are rigid and hold their shape after being installed in the base, allowing a child to move the beads back and forth along the rigid wires. This type of toy is generally intended for small children and has been relatively popular in recent years.

At the present time, various types of bead maze toys are offered by different manufacturers. For example, Hasbro offers a bead maze called Busy Beads and applicant's assignee offers a bead maze called Play N' Shape Beads. Other manufacturers offer competitive products.

Because the typical user of this toy is a child, it should be constructed in such a fashion as to be difficult to disassemble. Otherwise, the plurality of beads could be removed from the wires and misused.

In some prior art bead mazes, the beads and the wires are assembled in a two step operation. First, the beads themselves and a large locking plug are threaded onto the wire and second, the terminus of the wire is swedged to prevent the locking plug and beads from being slipped off the wire in the event that the toy is disassembled. The terminus of the wire is not bent into an L-shape. The locking plug contains a plurality of flexible prongs which extend outwardly from the plug. A plurality of slots are formed in the base to receive and engage the prongs on the plug. Once the plug is firmly inserted into the base, the resilient prongs engage the shoulders of the slots thereby locking the plug, wire and the beads onto the base.

The present invention is an improvement over prior art locking mechanisms used in the toy art and the general fastener art. The present invention does not require that the ends of the wires be swedged thus avoiding a two step assembly operation. Instead, the ends of the wires can be preformed into an L-shaped terminus thus reducing total manufacturing costs and expediting assembly of a bead maze.

SUMMARY OF THE INVENTION

The present invention can be used in the manufacture of a child's activity toy known as a bead maze. The bead maze consists of a base which supports a plurality of rigid wires which have a plurality of beads strung thereon. The beads are moved to and fro on the wires by a child. The wires are rigid and thus maintain their preformed shape after installation in the base. The wires are mounted in the base and their rigidity keeps them arranged in a general upright position relative to the base. The wires are typically twisted or curved and may be multicolored. The wires are elongate and both ends of each wire should be firmly secured to the base.

In the present invention, the terminus of each elongate wire is preformed into an L-shape. A generally rectangular shaped plug is formed with an L-shaped channel therein to receive and engage the L-shaped terminus of the wire. The plug has one or more resilient prongs extending outwardly from the plug with a resilient foot formed on the bottom of the plug. A receptacle is formed in the base to receive and engage the plug. One or more slots are formed in the receptacle to engage the prongs. The prongs on the plug engage a shoulder in the slotted receptacle to lock the plug, the wire, and the beads to the base.

In the bottom of the receptacle is a step which engages the foot on the bottom of the plug. The resilient foot tends to urge the plug in an upward fashion so that the top of the plug is relatively coplanar to the surface of the base.

In an alternative embodiment, the resilient foot can be formed in the bottom of the receptacle in lieu of the step. The resilient foot then engages the bottom of a plug which act as the step. This alternative embodiment is not believed to be as economical as the preferred embodiment which utilizes an integral plug having a foot which engages a step formed in the bottom of the receptacle.

BRIEF DESCRIPTION OF THE DRAWINGS

So that the manner in which the above recited features, advantages and objects of the present invention are attained and can be understood in detail, more particular description of the invention, briefly summarized above, may be had by reference to the embodiments thereof which are illustrated in the appended drawings.

It is noted, however, that the appended drawings illustrate only typical embodiments of this invention and are therefore not to be considered limiting of its scope, for the invention may admit to other equally effective embodiments.

DESCRIPTION OF THE PREFERRED EMBODIMENT

Figure 1:
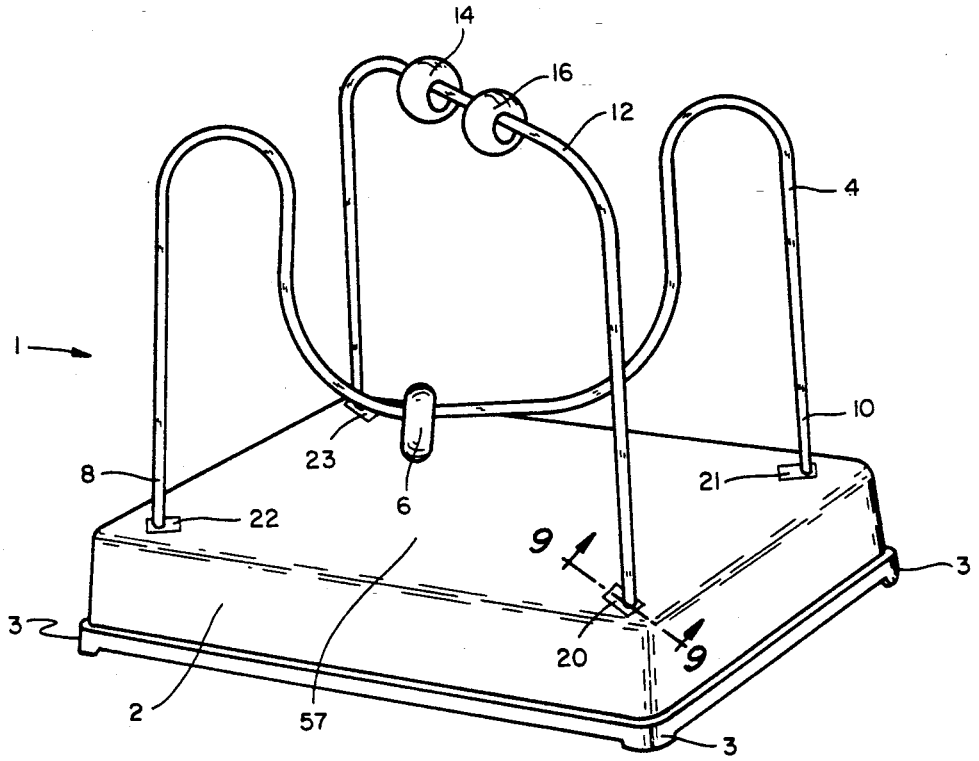
FIG. 1 is a perspective view of a child's activity toy generically referred to as a bead maze.

Referring to FIG. 1, the numeral 1 generally identifies a child's activity toy generically referred to as a bead maze. The bead maze 1 consists of the following three primary elements: a base or support structure 2; a curved elongate rigid wire 4; and a bead 6. The first wire 4 has a first end 8 and a second end 10 which are rigidly connected to the base 2. The bead 6 has a large aperture in the middle thereof which exceeds the outside diameter of the wire 4. The bead 6 can be moved along the wire 4 from the first end 8 to the second end 10. The wire 4 could also be described simply as an elongate member manufactured from any relatively rigid substance; however, in the best mode the elongate member is formed from rigid wire. The wire must be rigid enough that the L-shaped terminus 48, shown in FIG. 4, will hold its shape and cannot be pulled from the base 2 by a child. The wire must also be rigid enough to hold its curved shape after installation in the base 2.

In a typical bead maze there will be a plurality of beads strung on each wire and there will be a plurality of wires positioned on each base. The bead maze 1 only has two wires mounted thereon to simplify explanation of the device; however, it is common for a bead maze to have up to six wires mounted on the base. The bead maze 1 is shown with a second wire 12 rigidly mounted on the base 2. A second bead 14 and a third bead 16 are movably mounted on the second wire 12.

The first wire 4 is mounted on the base at the first end 8 by a plug 22. A second plug 21 is used to connect the other end 10 of the wire 4 to the base 2. Plugs 22 and 21 are identical in configuration. Likewise, wire 12 is secured to the base 2 by plugs 20 and 23 respectively positioned on each end of wire 12 as shown in the drawing.

The base 2 has a generally flat surface 57 which is typically raised above the legs 3. The wires 4 and 12 extend from the flat surface 57 in a generally upright condition. However, in other designs the wires 4 and 12 could be positioned at an angle relative to the surface 57 or they could extent from other parts of the base 2.

Figure 2:
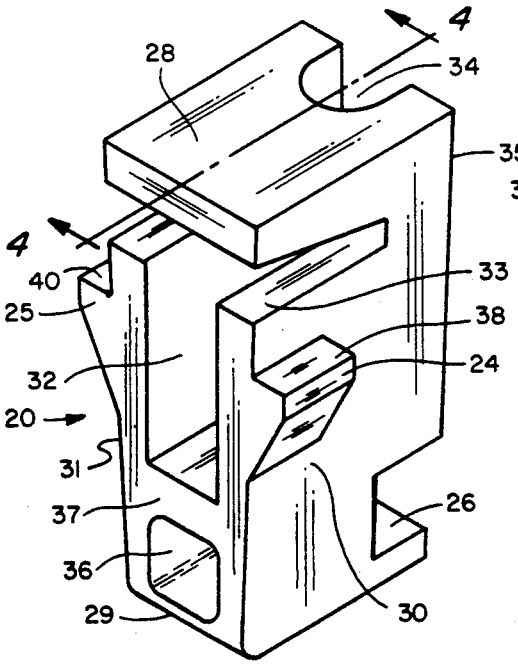
FIG. 2 is a front perspective view of the plug.

Referring to FIG. 2, the plug 20 is shown in enlarged view. The plug 20 includes a first prong 24 and a second prong 25 both of which extend outwardly from the plug 20. The plug 20 also includes a resilient foot 26 extending from the plug. In the preferred embodiment the plug 20 is an injection molded integral component formed from high density polyethylene. Those skilled in the art will recognize that the plug can be formed of many other suitable materials. Furthermore, it is desirable to manufacture the plug 20 as a one piece component; however those skilled in the art will recognize that it could also be manufactured from several different pieces which is also within the scope of the invention.

The plug 20 includes a generally flat top surface 28 and a bottom surface 29. The first prong 24 extends from a side surface 30 and the second prong 25 extends from an opposing side surface 31. In the preferred embodiment, the prongs 24 and 25 which extend from opposing side surfaces 30 and 31 respectively are able to flex in and out so that the plug can be properly assembled with the base 2. In order to achieve this flexibility a central opening 32 and a first notch 33 are formed in the plug 20.

An L-shaped channel 34 is formed in the plug. The L-shaped channel 34 runs from the top surface 28 along the rear surface 35 of the plug 20, through a bore 36 and extends to the front surface 37 of the plug 20. The first prong 24 has a shoulder 38 formed on the upper portion thereof. The second prong 25 likewise has a shoulder 40 formed on the upper surface thereof.

Figure 3:
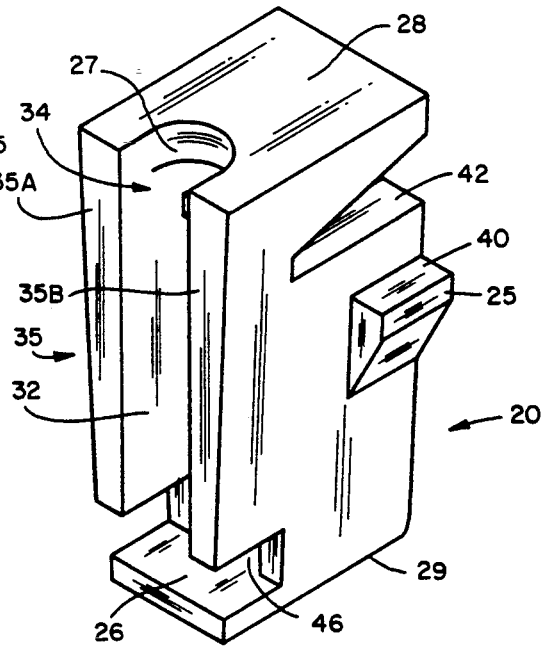
FIG. 3 is a reverse perspective view of the plug shown in FIG. 2.

Referring to FIG. 3, the plug 20 is shown in perspective view in opposition position from that of FIG. 2. The L-shaped channel 34 can be better seen in this Figure. The L-shaped channel 34 runs from the top surface 28 along the rear surface 35 of the plug 20 through the bore 36.

The rear surface 35 of the plug 20 includes a first elongate member 35A and a second elongate member 35B. In the top surface 28 there is a u-shaped groove 27 sized to receive the wire 12. The u-shaped groove 27, the elongate members 35A and 35B and the bore 36 define the L-shaped channel 34. The groove 27 and the elongate members 35A and 35B tend to position the wire 12 in a generally upright position together with the base 2 as better shown in subsequent drawings. The bore 36 engages the L-shaped terminus 48 of the rigid wire 12 and prevents the wire 12 from being removed after the plug 20 and wire 12 are inserted into the receptacle 50 of the base 2. A second notch 46 is formed near the bottom of the plug 20 to insure that the foot 26 can flex upon engagement with the step 58 described in FIG. 5.

Figure 4:
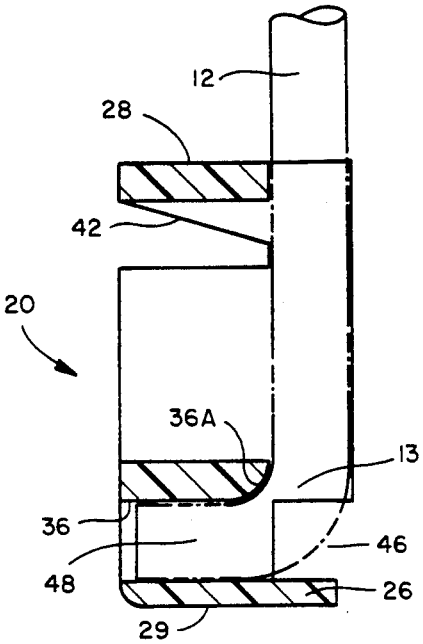
FIG. 4 is a section view of the plug taken along line 4—4 of FIG. 2 with an L-shaped wire positioned therein.

FIG. 4 is a section view of the plug 20 taken along the line 4—4 of FIG. 2. The wire 12 has been position in the L-shaped channel 34. The wire 12 has an L-shaped terminus 48 formed on the end thereof which engages the bore 36. The bore 36 has a curved portion 36A sized and arranged to engage the curve 13 in the wire 12 as shown in FIG. 4.

Figure 5:
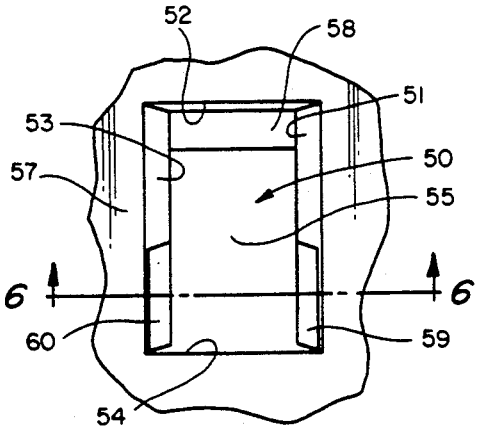
FIG. 5 is a top plan view of a receptacle formed in a base.

Referring to FIG. 5, a receptacle is generally identified by the numeral 50. In the preferred embodiment the receptacle 50 is formed as an integral element with the base 2. In other less efficient embodiments the receptacle 50 could be formed as a separate component and subsequently attached to the base 2. The receptacle 50 is defined by four sidewalls respectively identified by the numerals 51, 52, 53 and 54 and a bottom 55. The receptacle 50 has a top opening 56 formed in the horizontal surface 57 of the base 2, better seen in FIG. 6. At the bottom of the receptacle 50 is a step 58. Slots 59 and 60 are sized and arranged to respectively receive prongs 24 and 25 of the plug 20.

Figure 6:
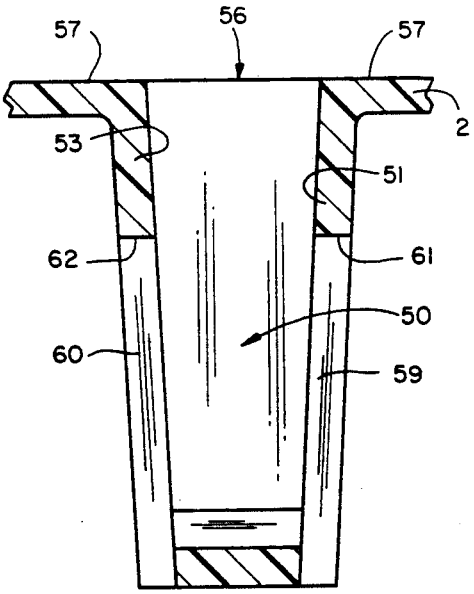
FIG. 6 is a section view of the receptacle and base taken along line 6—6 of FIG. 5.

Referring to FIG. 6, the receptacle is generally identified by the numeral 50. A shoulder 61 is formed in the upper portion of the slot 59. A second shoulder 62 is formed in the upper portion of the second slot 60. When assembled, the shoulder 38 of the prong 24 engages the shoulder 61 of slot 59. Likewise the shoulder 40 of prong 25 engages the shoulder 62 of the slot 60 to lock the plug 20 in place when it is fully inserted into the receptacle 50. The base 2 and the receptacle 50 are formed from high density polyethylene. The plug 20 is also formed from high density polyethylene. Those skilled in the art will recognize that other substances can be used to manufacture the base 2, the receptacle 50 and the plug 20.

For purposes of claim interpretation the term slot can be used as an inclusive term, for example to define both the slot 59 and the shoulder 61. Likewise, the term prong can be used as an inclusive term, for example to define both the prong 24 and the adjacent shoulder 38.

Figure 7:
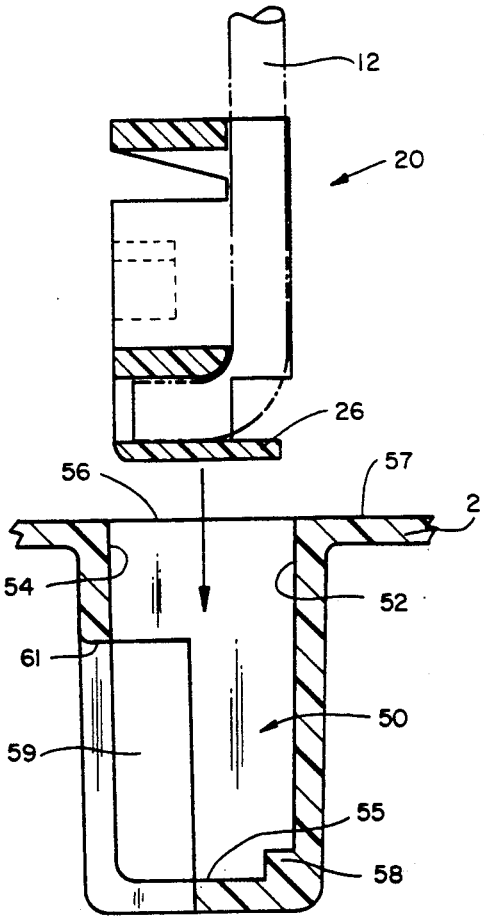
FIG. 7 is a section view of a wire engaging a plug prior to insertion of the wire and the plug in the receptacle.

Referring to FIG. 7, the wire 12 has been placed in the plug 20. During the assembly process the wire will be used as a tool to install the plug 20 into the receptacle 50 as shown by the arrow in the drawing. This facilitates assembly and is an improvement over prior art designs which require manipulation of the wire such as swedging or the use of speed nuts.

Figure 8:
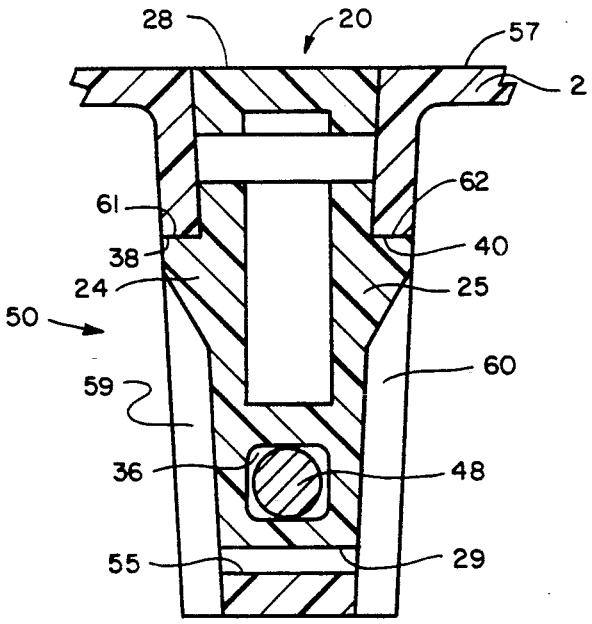
FIG. 8 is a section view of the plug and wire fully inserted in the receptacle taken along line 8—8 of FIG. 9.
Figure 9:
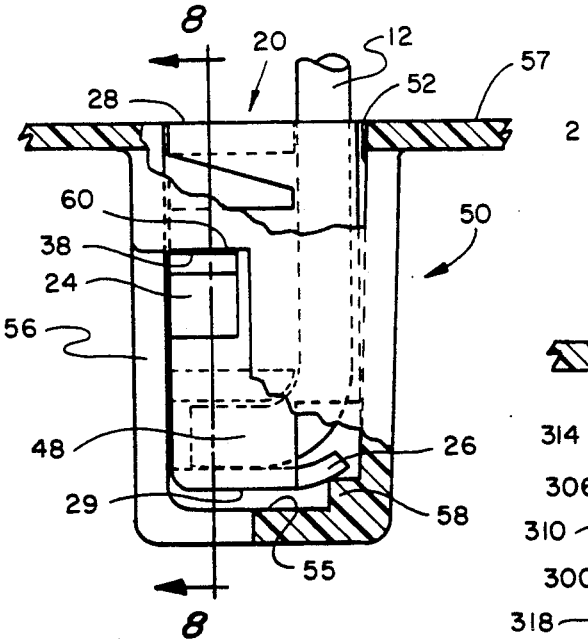
FIG. 9 is a section view taken along the line 9—9 of FIG. 1 of the plug and the wire fully inserted in the receptacle showing the foot engaging and being deformed by the step.

FIG. 8, is a section view of the plug 20 inserted in the receptacle 50 taken along the line 8—8 of FIG. 9. The plug 20 is fully inserted in the receptacle 50 with the wire 1 locked in place. Because this wire 12 is rigid it will be held in an upright fixed position above the base 2. In this section drawing, the L-shaped terminus 48 of the wire 12 is shown in the bore 36. The top 28 of the plug 20 is in a generally coplanar condition with the horizontal surface 57 of the base 2.

The prong 25 engages the slot 60. The shoulder 40 of the prong 25 engages the shoulder 62 of the slot 60. The prong 24 engages the slot 59. The shoulder 38 of the prong 24 engages the shoulder 61 of the slot 59. The bottom surface 29 of the plug 20 does not contact the bottom surface 55 of the receptacle 50.

In FIG. 9 the plug 20 and the wire 12 are shown fully inserted in the receptacle 50 of the base 2. The foot 26 of the plug 20 engages and is deformed by the step 58 of the receptacle 50. Because the foot 26 is resilient it tends to urge the plug 20 upward away from the bottom 55 of the receptacle 50. The foot 26 tends to urge the top 28 of the plug 20 into a generally coplanar relationship with the horizontal surface 57 of the base 2. The foot 26 interacting with the step 58 functions as a means for urging the shoulders of the prong of the plug 20 into locking engagement with the shoulders of the slots of the receptacle 50.

Those skilled in the art will recognize that there are other equivalent means for urging the shoulder 38 and 40 of the prongs 24 and 25 into locking engagement with the shoulder 61 and 62 of the slots 59 and 60 such as, but not limited to, a coil spring placed in the bottom 5 of the receptacle 50 in lieu of the foot 26 and the step 58.

When the wire 12 and the plug 20 are locked into the receptacle 50, the wire 12 is held in a generally upright and rigid condition. The wire 12 is supported by the interaction of the sidewall 52 of the receptacle 50 and the L-shaped channel 34, previously described, of the plug 20. In the preferred embodiment two prongs are used on each plug to strengthen the locking feature of the mechanism. In alternative embodiments only one prong may be utilized; however, from a safety point of view it is not recommended. The L-shaped terminus 48 of the wire 12 engages the bore 36 of the plug 20 thus preventing removal of the wire 12 after the plug has been locked into engagement with the receptacle 50.

Figure 10:
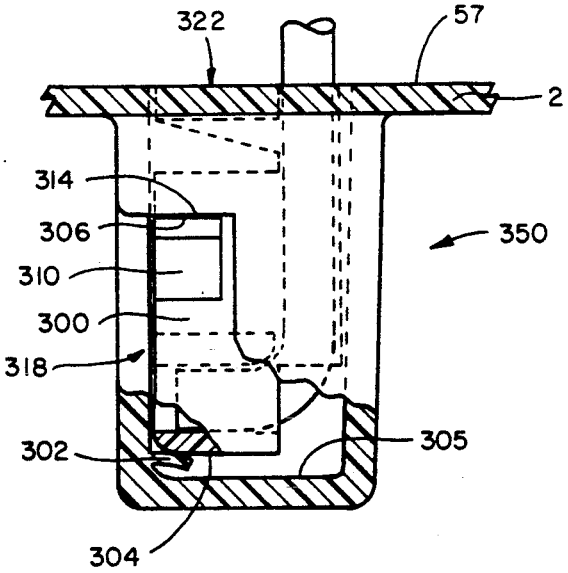
FIG. 10 is a section view of an alternative embodiment showing the foot formed in the base of the receptacle engaging and being deformed by the plug which now acts as the step shown in the previous figures.

Referring to FIG. 10, an alternative embodiment is shown. A slightly revised plug 300 is configured similar to the plug 20 except that there is no foot 26 on the plug. A slightly restructured receptacle 350 is configured similar to the original receptacle 50 except that there is no step 58. In lieu of the foot 26 and the step 58, a foot 302 is formed in the receptacle 350 to engage the bottom surface 304 of the plug 300. The foot 302 is resilient and tends to urge the plug 300 upward away from the bottom 305 of the receptacle 350. The resilient foot 302 tends to guarantee a locking engagement of the shoulder 306 of the prong 310 with the shoulder 314 of slot 318 and insures a generally coplanar relationship between the top 322 of the plug 300 and the generally horizontal surface 57 of the base 2.

While the foregoing is directed to the preferred embodiment of the present invention, other and further embodiments of the invention may be devised without departing from the basic scope thereof, and the scope thereof is determined by the claims which follow.

What is claimed:

1. An apparatus for attaching a rigid wire having an L-shaped terminus to a base comprising:

a. a plug including;

1) at least one prong extending outwardly from said plug;
2) an L-shaped channel formed in said plug receiving and engaging the L-shaped terminus of the wire; and b. a receptacle formed in the base, said receptacle receiving said plug and the wire, said receptacle forming at least one slot, receiving said prong, and said slot having a shoulder engaging said prong to lock said plug.

2. The apparatus of claim 1 further including means for urging said prong of said plug into locking engagement with said shoulder of said slot.

3. The apparatus of claim 1 further including:

a. an integral resilient foot extending from said plug; and b. a step formed in the bottom of said receptacle, said step engaging said foot when said plug is fully inserted in said receptacle.

4. A plug locking a rigid elongate member having an L-shaped terminus to a receptacle in a base comprising:

a. at least one integral shaped prong extending outwardly from said plug to engage the receptacle in the base and lock the plug and the rigid elongate member in the base;

b. at least one integral resilient foot extending from said plug to urge said shaped prong and the rigid elongate member into a fixed position in the receptacle and relative to the base; and c. an L-shaped channel formed in said plug receiving and supporting the L-shaped terminus of the elongate member.

5. A base having a receptacle sized and receiving a plug and a rigid elongate member, the plug including at least one shaped prong and a foot, the receptable including:

a. a step formed in the bottom of said receptacle, said step engaging the foot when the plug is fully inserted in said receptacle, said foot urging said plug and the rigid elongate member into a fixed position in the base; and b. at least one slot formed in said receptacle, receiving and engaging the v-shaped prong when the plug and the elongate member are fully inserted into said receptacle to lock the plug and the elongate member in a fixed position in said receptacle relative to the base.

6. A toy comprising:

a. a base including at least one receptacle therein, said receptacle including a step therein;

b. at least one generally upright, elongated member supported on said base, said member having an L-shaped terminus;

c. at least one bead movably positioned on said member; and d. locking means lockably connecting said member to said base and supporting said member in the generally upright position in said receptacle, said locking means comprising a plug positioned in said receptacle, said plug including a bore therein receiving at least a portion of said L-shaped terminus, a locking prong extending from said plug for locking contact under a portion of said base, said plug including a resilient portion resiliently deformed by said step in said receptacle to resiliently urge said locking prong into locking contact with said base and thereby lock said plug and said member in said receptacle and support and connect said member in said base.

7. A toy according to claim 6 wherein said locking prong resiliently extends from said plug and is adapted to be deformed for insertion of said plug into said receptacle and resiliently resume its original position after such insertion.

8. A toy comprising:

a. at least one elongate and rigid wire having a first L-shaped terminus on one end and a second L-shaped terminus on the opposite end;

b. at least one bead, having a bore there through, said bore receiving said wire, said bore sized to permit free movement of said bead along said wire;

c. a first plug including;
1) a pair of opposing prongs extending outwardly from said plug;
2) a foot extending from said plug;
3) an L-shaped channel formed in said plug to receiving and aiding in the support of said first L-shaped terminus on one end of said wire;

d. a second plug including;
1) a pair of opposing prongs extending outwardly from said second plug;
2) a foot extending from said second plug;
3) an L-shaped channel formed in said second plug to receiving and aiding in the support of said second L-shaped terminus on said opposite end of said wire;

e. a base having at least a first receptacle formed therein receiving and engaging said first plug and a second receptacle formed therein receiving and engaging said second plug, to aid in the support of said wire in a generally upright position, relative to said base;

f. said first receptacle including;
1) a step formed in the bottom of said receptacle, said step engaging said foot when said first plug is fully inserted in said receptacle;
2) a pair of opposing slots formed in said receptacle, receiving and engaging said prongs when said first plug and said wire are fully inserted in said receptacle to lock said first plug and said wire in said receptacle;

g. said second receptacle including;
1) a step formed in the bottom of said second receptacle, said step engaging said second foot when said plug is fully inserted in said receptacle;
2) a pair of opposing slots formed in said receptacle, receiving and engaging said prongs when said second plug and said wire are fully inserted in said second receptacle to lock said second plug and said wire in said second receptacle.

9. A toy with at least one generally upright wire, at least one bead positioned and freely movable along the wire and a base supporting the wire, the toy comprising:

a. a plug including;
1) at least one prong extending outwardly from said plug;
2) an integral resilient foot extending from said plug; and
3) an L-shaped channel formed in said plug receiving and aiding in the support of said wire; and b. a receptacle attached to said base, said receptacle receiving said plug and the wire, and aiding in the support of said wire in a generally upright position, said receptacle including;

1) a step formed in the bottom of said receptacle, said step engaging said foot when said plug is fully inserted in said receptacle; and 2) slot formed in said receptacle, engaging said prong when said plug and the wire are inserted in said receptacle to lock said plug and the wire in said receptacle.

10. A toy with at least one generally upright wire, at least one bead positioned and freely movable along the wire and a base supporting the wire, the toy comprising:

a. a plug including:

1) at least one prong extending outwardly from said plug;

2) an L-shaped channel formed in said plug receiving and aiding in the support of said wire; and b. a receptacle attached to said base, said receptacle receiving said plug and the wire, and aiding in the support of the wire in a generally upright position, said receptacle including;

1) a resilient foot extending from the bottom of said receptacle, said foot engaging the bottom of said prong when said plug is fully inserted in said receptacle;

2) at least one slot formed in said receptacle, engaging said prong when said plug and the wire are fully inserted in said receptacle to lock said plug and the wire in said receptacle.

* * * * *